US006973282B2

(12) United States Patent
Schulmeister et al.

(10) Patent No.: US 6,973,282 B2
(45) Date of Patent: Dec. 6, 2005

(54) DEVICE FOR TRANSPORTING TONERS TO/FROM A TONER DEPOSITION UNIT IN AN ELECTROPHOTOGRAPHIC PRINTING OR COPYING DEVICE

(75) Inventors: Peter Schulmeister, Pfaffenhofen (DE); Uwe Höllig, München (DE)

(73) Assignee: Oce Printing Systems GmbH, Poing (DE)

( * ) Notice: Subject to any disclaimer, the term of this patent is extended or adjusted under 35 U.S.C. 154(b) by 0 days.

(21) Appl. No.: 10/506,957

(22) PCT Filed: Mar. 26, 2003

(86) PCT No.: PCT/EP03/03141

§ 371 (c)(1),
(2), (4) Date: Mar. 23, 2005

(87) PCT Pub. No.: WO03/081342

PCT Pub. Date: Oct. 2, 2003

(65) Prior Publication Data

US 2005/0180783 A1 Aug. 18, 2005

(30) Foreign Application Priority Data

Mar. 26, 2002 (DE) ..... 102 13 499

(51) Int. Cl.[7] ..... G03G 15/09

(52) U.S. Cl. ..... 399/276; 399/265; 399/273; 399/279; 492/30

(58) Field of Search ..... 399/265, 267, 399/272, 273, 276, 279, 281, 283, 286; 492/18, 492/28, 30, 37, 54, 58; 430/120, 126

(56) References Cited

U.S. PATENT DOCUMENTS

| | | | | |
|---|---|---|---|---|
| 5,245,391 | A * | 9/1993 | Suzuki et al. | 399/286 X |
| 5,311,263 | A * | 5/1994 | Suzuki et al. | 399/276 |
| 5,339,141 | A * | 8/1994 | Suzuki et al. | 399/286 X |
| 5,387,963 | A * | 2/1995 | Kajimoto et al. | 399/273 X |
| 5,451,713 | A * | 9/1995 | Suzuki et al. | 399/285 |
| 5,474,869 | A * | 12/1995 | Tomita et al. | 430/102 |
| 5,563,690 | A * | 10/1996 | Hasegawa et al. | 399/286 |
| 5,851,719 | A | 12/1998 | Takei et al. | 430/126 |
| 6,026,265 | A | 2/2000 | Kinoshita et al. | 399/281 |
| 6,035,171 | A * | 3/2000 | Takaya et al. | 399/281 |
| 6,072,977 | A | 6/2000 | Murakami | 399/313 |
| 6,077,207 | A * | 6/2000 | Yokoyama et al. | 492/30 |
| 6,181,902 | B1 | 1/2001 | Kopp | 399/228 |
| 6,226,483 | B1 * | 5/2001 | Kazakos et al. | 399/279 X |
| 6,489,073 | B2 * | 12/2002 | Kotsugai et al. | 399/265 X |
| 6,526,248 | B1 | 2/2003 | Aoki et al. | 399/286 |

(Continued)

FOREIGN PATENT DOCUMENTS

DE 41 28 942 A1 7/1992

(Continued)

OTHER PUBLICATIONS

Patent Abstracts of Japan—58132769—Aug. 8, 1983.

(Continued)

*Primary Examiner*—S Chen
(74) *Attorney, Agent, or Firm*—Schiff Hardin LLP

(57) ABSTRACT

In a device for transporting toner in an electrophotographic printing or copying device, a rotatable cylinder has a cylinder sheath. The cylinder such includes a metallic layer having a surface with a roughness search that at least one of peaks and columns are provided along with recesses. The recesses of the surface are filled with plastic. Also, the cylinder sheath may include a layer of a porous ceramic material having a roughness.

20 Claims, 5 Drawing Sheets

U.S. PATENT DOCUMENTS

| | | | | |
|---|---|---|---|---|
| 2002/0028096 | A1 | 3/2002 | Satoh et al. | 399/286 |

FOREIGN PATENT DOCUMENTS

| | | | |
|---|---|---|---|
| DE | 197 49 386 | C2 | 2/2000 |
| DE | 101 52 892 | A1 | 6/2003 |
| EP | 1 126 329 | A1 | 8/2001 |
| WO | WO 03/036393 | A2 | 5/2003 |

OTHER PUBLICATIONS

Patent Abstracts of Japan 60247669—Dec. 7, 1985.
Patent Abstracts of Japan 05142931—Jun. 11, 1993.
Patent Abstracts of Japan 05181366—Jul. 23, 1993.
Patent Abstracts of Japan 08179616 Jul. 12, 1996.
Patent Abstracts of Japan 09026701 Jan. 28, 1997.
Patent Abstracts of Japan 2001083795 Mar. 30, 2001.

* cited by examiner

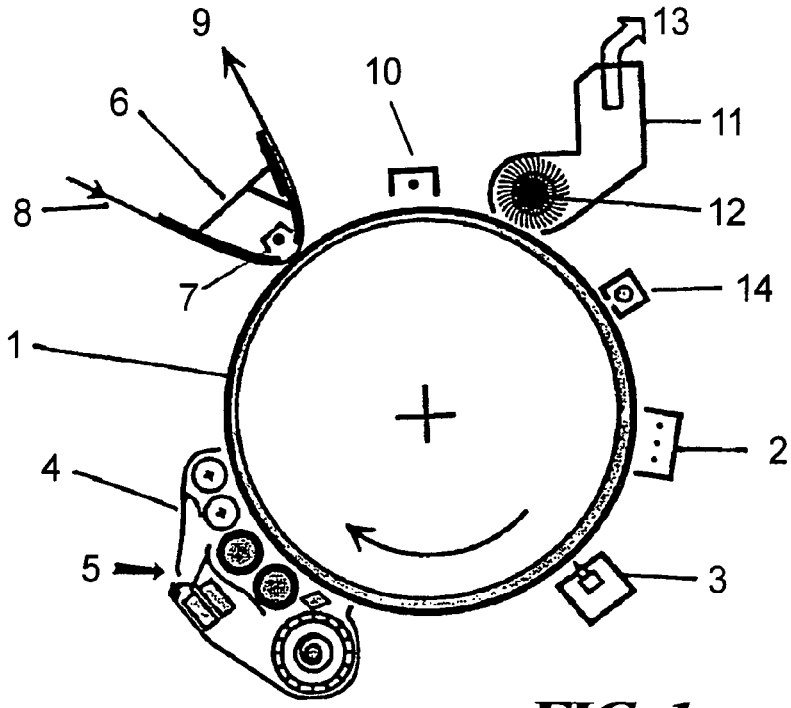
FIG. 1
(PRIOR ART)
FIG. 2
(PRIOR ART)
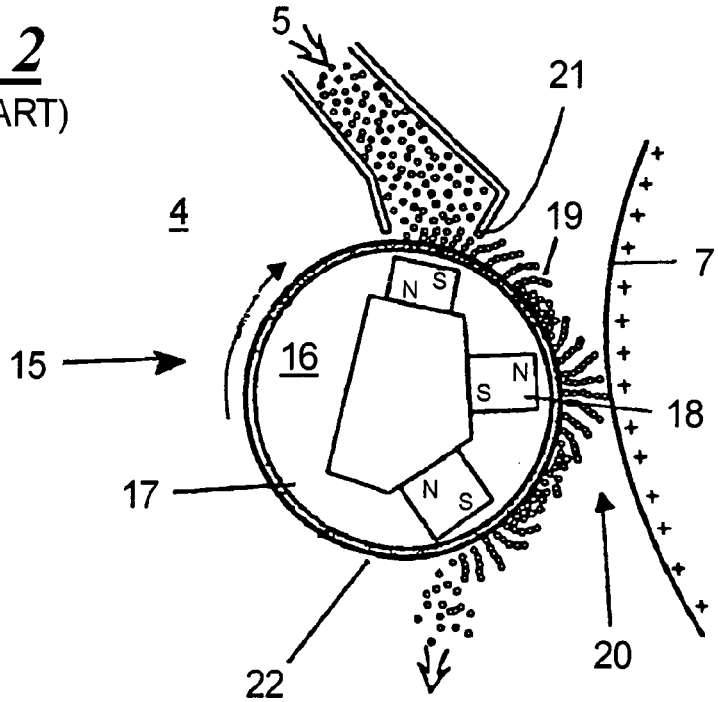

DEVICE FOR TRANSPORTING TONERS TO/FROM A TONER DEPOSITION UNIT IN AN ELECTROPHOTOGRAPHIC PRINTING OR COPYING DEVICE

BACKGROUND

Electrophotographic printing or copying devices are known for example from U.S. Pat. No. 6,072,977 or DE 197 49 386 C2. They have a design as shown in FIG. 1. FIG. 1 shows a schematic arrangement of the components used for operation. An intermediate carrier 1 (in FIG. 1 this is a photoconductor drum, but the intermediate carrier can also be a photoconductor strip or band moves past components 2–7, 10–14 with a constant speed. First, intermediate carrier 1 is charged by a charge corotron 2. Using sharply bundled light, the image to be printed is produced as a charge image on intermediate carrier 1 by a character generator 3. Subsequently, the charge image is inked with toner in a developer station 4. Developer station 4 comprises at least one device for transporting the toner; this device transports developer 5, made up of toner and a carrier, to intermediate carrier 1. The toner thereby moves onto intermediate carrier 1 in the gap between developer station 4 and intermediate carrier 1 in a manner corresponding to the charge images. Finally, the toner image is transferred onto a print medium 8, for example paper, in a transfer station 6, for example using a transfer corotron 7, and is then fixed in a fixing station 9 (not shown). Subsequently, intermediate carrier 1 is electrostatically neutralized using a corotron 10. The residual toner still adhering to intermediate carrier 1 is removed for a new image cycle using a cleaning device 11, for example a cleaning brush 12 and suction unit 13. Finally, in order to improve its long-term behavior, intermediate carrier 1 is exposed with a discharge lamp 14. Intermediate carrier 1 is now ready for a new print cycle.

FIG. 2 shows an example of a standard developer station 4 that contains a device 15 for transporting toner to an intermediate carrier 1. In FIG. 2, the device for transporting the toner is realized as a magnetic cylinder 16 having a rotating cylinder 17 that comprises an electrically conducting sheath 22 to which developer 5 adheres, and having a magnet system 18 situated in its interior. Developer 5 is mixed in developer station 4, and the toner is thereby triboelectrically charged by friction. Corresponding to the magnetic field lines of magnet system 18, the developer then forms chains 19 that bridge developer gap 20 and contact intermediate carrier 1. Due to the charge of intermediate carrier 1 and the difference in potential between intermediate carrier 1 and magnetic cylinder 16, the toner is detached from the carrier and is transferred onto intermediate carrier 1. The carrier then falls back into developer station 4. Using a stripper 21, the thickness of developer 5 on cylinder sheath 22 is set.

A further developer station can be learned from U.S. Pat. No. 6,181,902 B1. Here, a charged toner is moved past an intermediate carrier, via an applicator cylinder that is adjacent to a pre-voltage, and charge images on the intermediate carrier are thereby tinted.

In FIGS. 1 and 2, a magnetic cylinder is provided as an example of a device for transporting toner to an intermediate carrier. However, this device can also be an additional magnetic cylinder that conveys developer to a magnetic cylinder or to an applicator cylinder, corresponding to U.S. Pat. No. 6,181,902 B1. Finally, the device can also be used for cleaning an intermediate carrier, a cylinder that transports toner, or an applicator cylinder. For this reason, in the following reference will be made to a toner deposition unit, referring in combination to all cases of application of the device.

The devices used in electrophotographic printing devices for transporting toner to or from a toner deposition unit thus comprise, as is shown in FIG. 2, at least one cylinder having a sheath (cylinder sheath) to which the toner adheres. However, dependent on the electrical field force on the correspondingly charged toner, the device is itself subject to an undesirable process of toner deposition on the cylinder sheath. For example, there can be different potentials on the intermediate carrier (photoconductor drum, photoconductor strip) according to the discharge by the character generator or the non-discharge, so that in discharged areas toner moves from the cylinder sheath to the intermediate carrier, while in non-discharged areas toner is electrostatically deposited on the cylinder sheath due to the electrical field distribution. Due to their electrically insulating characteristic, these toner depositions result in a shielding against electrical charges, with the result that the transport of toner to the intermediate carrier is negatively influenced.

Systems are known that use a corresponding configuration of the magnets of the magnetic cylinder and/or that use a blade in the vicinity of the rotating cylinder sheath in order to bring about a constant toner/carrier mixture relative to the rotating cylinder sheath (DE 101 52 892.2). Due to the resulting mechanical friction between the ferromagnetic carrier particles and the cylinder sheath, the toner deposited thereon is rubbed off, and is absorbed again by the toner/carrier mixture.

However, dependent on the adhesive characteristics (material characteristic and surface roughness) of the cylinder sheath, as well as the physical properties of the toner and the carrier, the adhesive forces between the toner and the sheath surface can increase significantly, making adequate cleaning more difficult. A significant amount of frictional or rubbing work is then required to remove the toner from the cylinder sheath.

From the prior art, various constructions of the cylinder sheath are known:

The subject matter of U.S. Pat. No. 5,851,719 A is a developer roll having a magnet in the interior and a sheath made of metal, provided externally with a layer made of a resin, for example acrylic resin, that is doped with electrically conductive particles. Using such a developer roll, ghost images and the arising of toner dust are supposed to be prevented during the developing of charge images on an intermediate carrier. In addition, differences in charge in the toner particles, caused by the prehistory of the toner (fresh toner or residual toner) are supposed to be avoided. In addition, it is supposed to be achieved that the charging of the toner is constant over the width of the developer roll, independent of environmental conditions.

DE 41 28 942 A1 is based on the object of creating a developer device with which the image density is increased while the tonal values are maintained, and in which line images are prevented from becoming denser. For this purpose, a specially constructed developer roll is provided whose surface comprises electrically conductive first zones and dielectrically conductive second zones. The consequence is that the different zones can be at different potentials, so that alternating fields can be produced between the different zones, through which the transfer of toner onto the intermediate carrier is controlled. In this way, the advantages of a developer roll having a conductive surface in combination with those of a developer roll having a non-conductive surface are achieved, or the disadvantages thereof are avoided. A developer roll having a non-conducting surface accurately reproduces line fields in the desired shape and tones, while the image density is relatively low; a developer roll having a conductive surface produces an image having a high image density distribution, but is worse with respect to the line images. The developer roll is made of metal, for example aluminum, whose surface is knurled in a meshed pattern. The resulting recesses are filled with a dielectric epoxy resin, for example tetrafluorethylene.

In EP 1 126 329 A1, a developer roll is described that is to have a particularly smooth surface. For this purpose, the surface of the developer roll comprises a layer made of ceramic material, namely zirconium oxide or zirconium oxide with titanium.

The underlying problem of U.S. Pat. No. 6,026,265 A is to indicate a developer device in which, after developing, toner can be stripped from the developer roll without damaging or detaching the toner. For this purpose, an application roll is provided that both supplies toner to the developer cylinder before the developing and also strips off the remaining toner after the developing. The developer cylinder is made of aluminum onto which there is applied a phenol resin containing carbon, in order to produce a surface having a particular degree of roughness. The application roll is made of a silicon foam or polyurethane foam, applied on a metal shaft. In addition, the surface of the application roll is provided with grooves in the longitudinal direction. In this way, the supply of toner to the developer cylinder is improved, and after developing the residual toner is securely stripped off of the developer cylinder.

Finally, from U.S. 2002/028096 A1 there results a developer roll that comprises an electrically conductive shaft on which there is applied an elastic zone that is provided with a coating of resin. The elastic zone can be made of rubber, and the coating can be made of a resin that contains carbon. With this realization of the developer roll, with the use of single-component toner it is supposed to be achieved that given a high degree of electrical conductivity the roll can deform sufficiently, for example in contact with an intermediate carrier, and is elastic enough that it subsequently returns to the initial state.

In all these constructions of the cylinder sheath, the problem of the reduction of frictional work in the removal of toner from the cylinder sheath is not addressed.

In PATENT ABSTRACTS OF JAPAN, vol. 2000, no. 20, 10 Jul. 2001 (2001-07-10) & JP 2001 083795 A, a developer cylinder is described in which the surface is coated with Teflon or with a PTFE or PTFE derivate. Carbon is added to the layer in order to obtain conductivity.

PATENT ABSTRACTS OF JAPAN, vol. 010, no. 119 (P-453), 6 May 1986 (1986-05-06) & JP 60 247669 describes a developer cylinder whose sheath is covered with a layer of PFA in which carbon powder is dispersed.

From PATENT ABSTRACTS OF JAPAN, vol. 017, no. 600 (P-1637), 4 Nov. 1993 (1993-11-04) & JP 05 181366 A, there results a developer cylinder whose sheath comprises a metallic layer that contains PTFE.

PATENT ABSTRACTS OF JAPAN, vol. 007, no. 249 (P-234), 5 Nov. 1983 (1983-11-05) & JP 58 132769 A discloses a method according to which a layer of PTFE is applied on the sheath of a developer cylinder.

PATENT ABSTRACTS OF JAPAN, vol. 1996, 29 Nov. 1996 (1996-11-29) & JP 08 179616 A describes a sheath of a developer carrier that is covered with a resin layer containing conductive particles and particles having low surface energy.

From PATENT ABSTRACTS OF JAPAN, vol. 1997, no. 05, 30 May 1997 (1997-05-30) & JP 09 026701 A there results a magnetic cylinder whose sheath is made of non-magnetic metallic material having electrical conductivity onto which a layer of non-rusting steel is thermally sprayed. The layer has a thickness of 10 to 100 $\mu$m, and has a roughness of 30 to 100 $\mu$m. In this way, the adhesion of the carrier to the magnetic cylinder is to be reduced, and a long lifespan is to be achieved.

PATENT ABSTRACTS OF JAPAN, vol. 017, no. 529 (P-1618), 22 Sep. 1993 (1993-09-22) & JP 05 142931 A describes a developer cylinder having strongly insulating properties. This is achieved in that an insulating layer made of $\alpha Al_2O_3$ is applied, or a layer of aluminum oxide is sprayed on, in whose pores an insulating material is introduced.

From WO 03 036393 A, which does not enjoy prior publication, but has an older priority date, there results a cleaning device for developer cylinders. As a cleaning device a cylinder is used whose surface has a low mechanical energy. For this purpose, a Teflon layer can be applied onto the cylinder, or an insulating material can be introduced into recesses of a rough surface of the cylinder.

SUMMARY

It is an object to indicate a device, comprising a cylinder having a sheath, for the transport of toner, constructed in such a way that a significant reduction of frictional work is achieved in the removal of the toner from the cylinder sheath.

A device is provided for transporting toner in an electrophotographic or printing or copying device comprising a rotatable cylinder having a cylindrical sheath for the transport of the toner. The cylinder sheath comprises a metallic layer having surface with a roughness such that at least one of peaks and columns are provides along with recesses. The recesses of the surface are filled with plastic.

A device is also provided for transporting toner in an electrophotographic printing or copying device comprising a rotatable cylinder having a cylinder sheath of the transport of the toner and wherein the cylinder sheath comprises a layer of a porous ceramic material.

BRIEF DESCRIPTION OF THE DRAWINGS

FIG. 1 is a diagram of an electrophotographic printing or copying device;

FIG. 2 is a diagram of an example of a standard developer station containing a device for transporting toner to an intermediate carrier;

DESCRIPTION OF THE PREFERRED EMBODIMENTS

Figure 3:
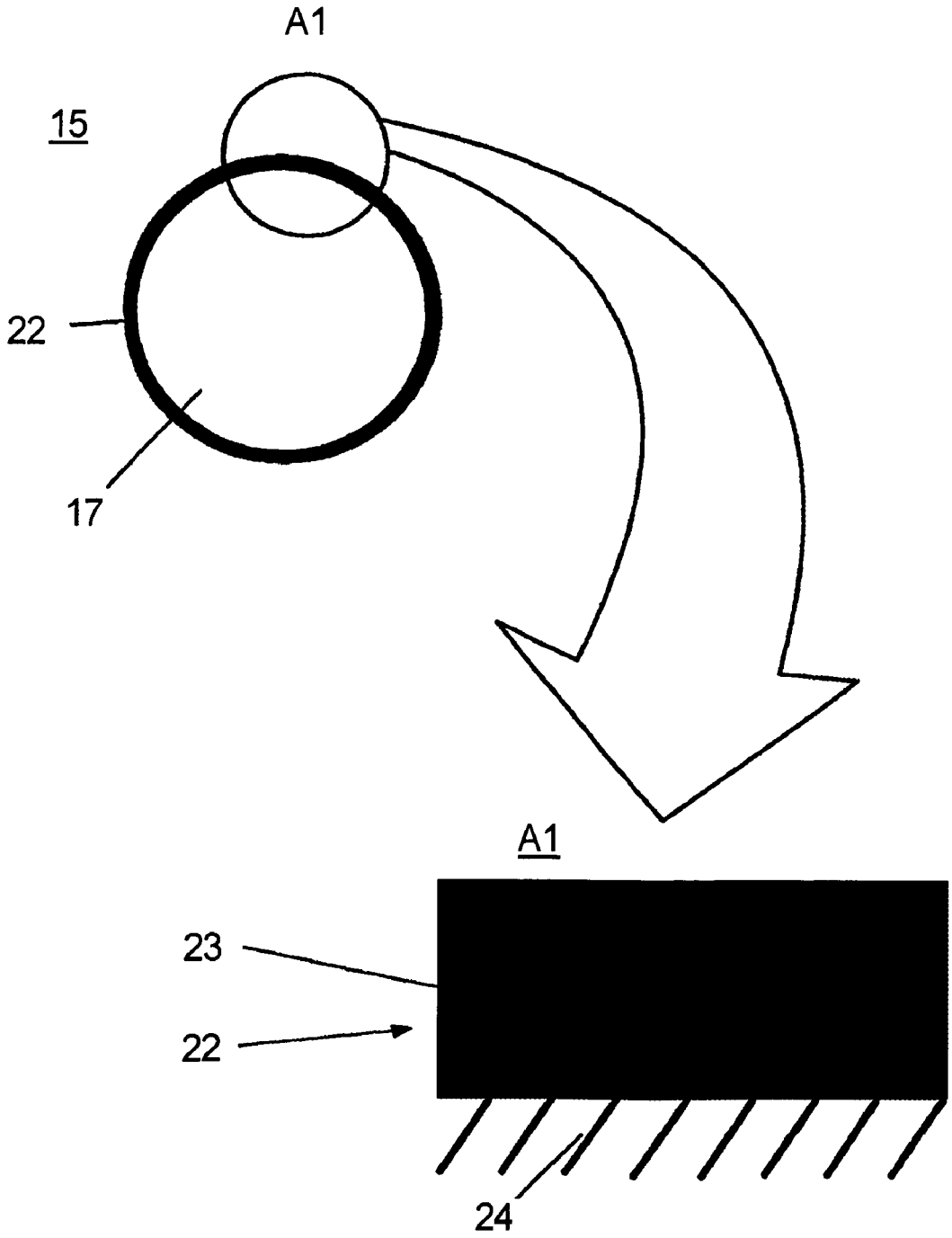
FIG. 3 shows a first exemplary embodiment.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

The problem of very high adhesive forces between the toner and the surface of the cylinder sheath, requiring a correspondingly high degree of frictional work for an adequate cleaning, is avoided by the use of a cylinder sheath having a particular design.

The properties of the surface of the cylinder sheath are set such that the adhesive forces to the toner are small. This can be achieved by selecting the surface energy of the sheath surface to be low. This also holds for metallic sheaths, made for example of high-grade steel or aluminum, which confer a very high degree of mechanical stability, but at the same time also have a high surface energy.

The cylinder sheath can advantageously be made of a metallic material having a very rough surface. Due to the resulting peaks or columns, the surface energy of the sheath surface is reduced, so that the developer can detach from the cylinder sheath through gravity alone. For further improvement, the recesses in the surface of the cylinder sheath can be filled with a plastic that has anti-adhesive properties.

A further specific embodiment comprises the coating of cylinder sheaths with anti-adhesive materials in order to facilitate the removal of layers of toner deposited thereon by mechanical friction, and in the particular construction of the layer or of the layer deposition, in order to ensure a flowing off of the electrical charge. The anti-adhesive and electrically conductive properties are in addition maintained over the entire life span of the device due to the special layer construction.

Coatings having low surface energy values can advantageously be achieved using plastics, such as for example PTFE, PTFE derivates, or related materials, whereby closed PTFE coatings are to be avoided, because due to their high electrical resistance they result in electrical insulation, and thus to loss of the electrical charge transport from or to the metallic conductive cylinder sheath. It is therefore advantageous to construct the cylinder sheath from a coating having a low surface energy, for example using PTFE or a PTFE derivate, which is then doped with an electrically conductive material, for example carbon.

In addition, it is advantageous to use PFA (polyfluoroalkoxy) as a coating.

Another advantageous realization of the cylinder sheath is one made of porous ceramic material having a roughness of 2–80 $\mu$m. The pores can in addition be filled for example with PFA, PTFE, or with a PTFE derivative.

FIG. 3 shows only a section through a cylinder 17, e.g. a magnetic cylinder, of device 15 for transporting toner to a tenor deposition unit, and sheath 22 of said cylinder. The other components result for example from FIG. 2. In addition, an enlarged segment A1 of a part of cylinder sheath 22 is shown. Segment A1 shows a cylinder sheath 22 having a metallic layer 24 and having a closed anti-adhesive layer 23 that is electrically conductive.

Layer 23 is realized in such a way that an electrical charge transport can be maintained. The layer can be made for example of PTFE doped with an electrically conductive material, e.g. carbon. Layer 23 can for example also be realized with an electrically conductive PFA. The layer thickness can be up to several 100 $\mu$m. The specific volume resistance can be in the range up to $10^9$ Ωcm. The layer can be deposited using a spray coating process in multiple layers of approximately 25 to 50 $\mu$m, and can be hardened in an oven.

Figure 4:
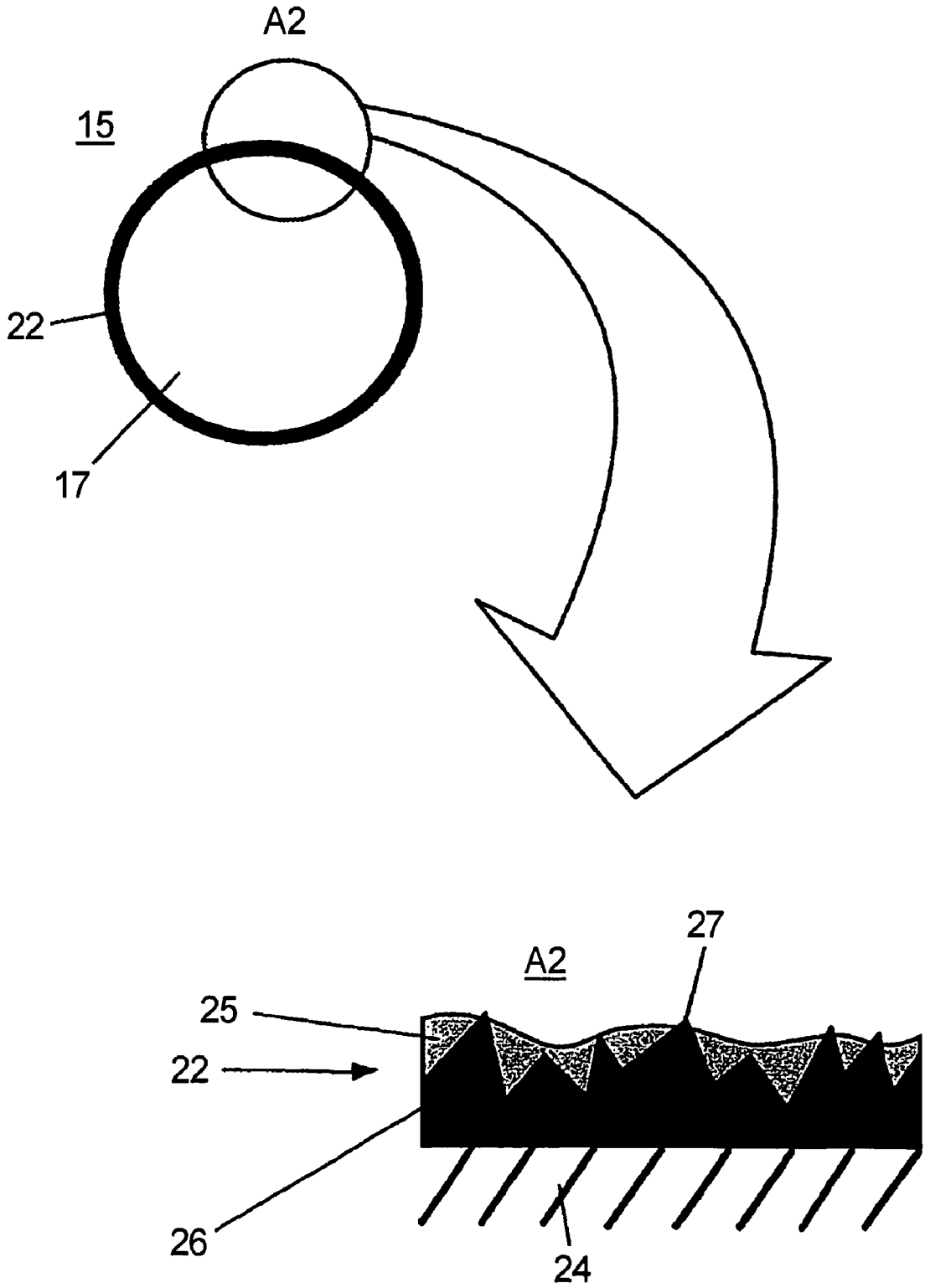
FIG. 4 shows a second exemplary embodiment.

FIG. 4 shows an additional specific embodiment of the present invention. Here, a cross-section of cylinder 17 with sheath 22 is again shown, with a detail shown in a larger scale as segment A2.

In this specific embodiment, the surface 26 of metallic cylinder sheath 22 is realized in such a way that it has a very high degree of roughness. A correspondingly rough surface, having peaks and columns 27, can be achieved either by partially wearing away the material (e.g. by sandblasting or etching) or by adding material (e.g. in a coating method using electrically conductive materials, e.g. CrNi plasma spraying, ceramic layer spraying). Such a construction of the surface of cylinder 22 has the effect that the toner or the developer is detached from the cylinder sheath due to centrifugal forces and gravity. This effect is made stronger if the recesses of the rough, electrically conductive, mechanically stable cylinder sheath are filled with a coating 25 made of an insulating material or an electrically conductive material, e.g. PTFE or a PTFE derivate. The electrically conductive peaks or columns 27 protruding through the coating thereby facilitate the electrical charge transport, and the adjacent PTFE-filled regions 25 help fulfill the anti-adhesive requirements. The advantage of this layer construction lies on the one hand in the increased mechanical stability of the surface (stabilization by wear-resistant columns or peaks) and on the other hand in the ensuring of a charge transport via the electrically conductive columns or peaks 27, which at least in part protrude past coating 25. Electrically insulating PTFE materials can hereby also be used for the filling.

The coating of cylinder sheath 22 in order to achieve a high degree of roughness can take place for example through the application of a thermally sprayed CrNi layer. Following this, the filling of the recesses of rough surface 26 can for example take place with a conductive PFA. The layer thickness can be up to several 100 $\mu$m. The specific volume resistance is in the range up to $10^9$ Ωcm. The layer can be applied using a special spray coating process in multiple layers of approximately 25 to 50 $\mu$m, and can be hardened in an oven.

Figure 5:
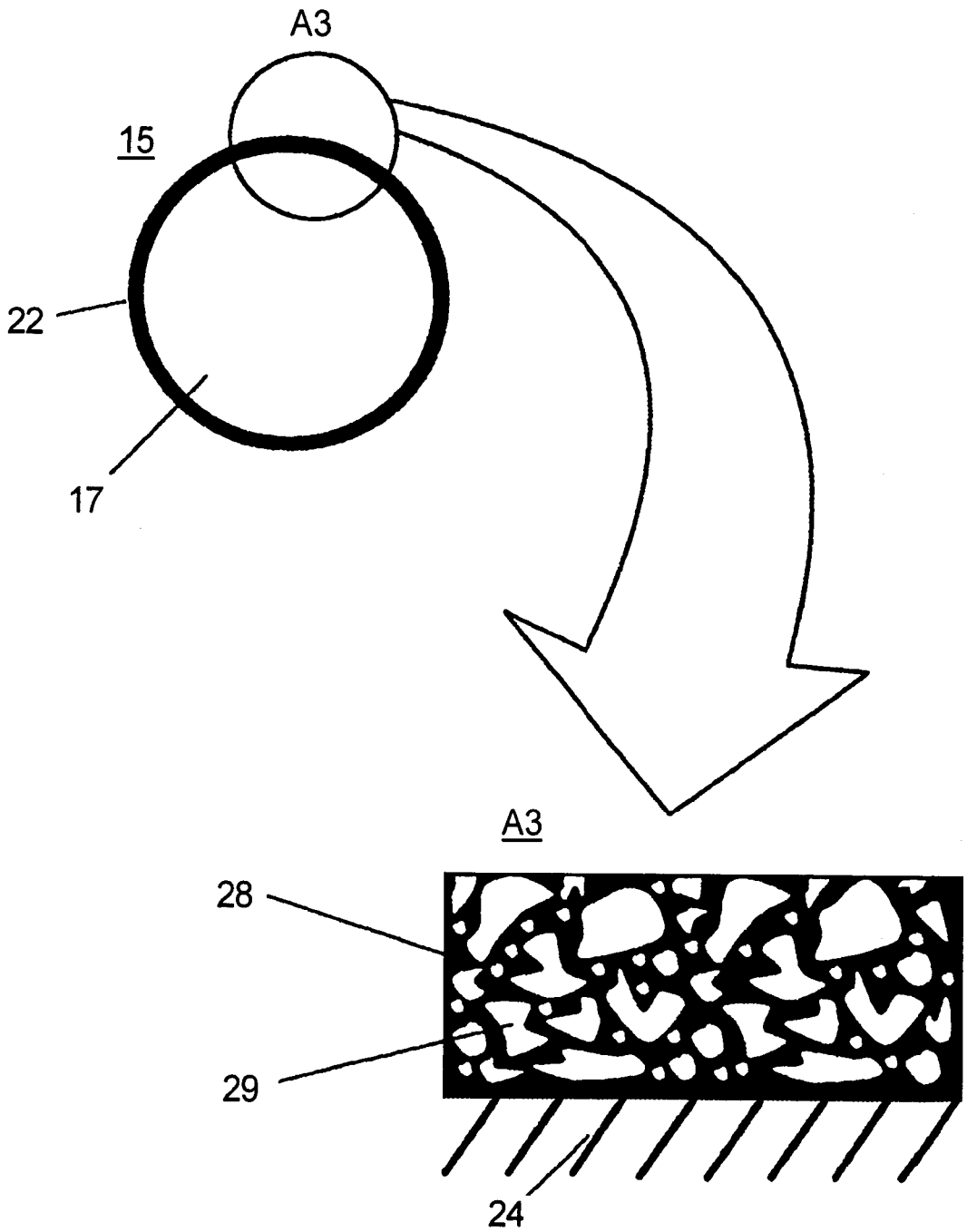
FIG. 5 shows a third exemplary embodiment.

FIG. 5 shows a third specific embodiment. Cylinder sheath 22 is again shown in cross-section, and a segment A3 thereof is shown in an enlarged scale. The combination of anti-adhesive properties, electrical conductivity, and mechanical stability is achieved through the use of composite materials 28. Composite materials can for example be constructed from porous thermal ceramic sprayed layers, whose specific volume resistance (electrical conductivity) is set by the mixing ratio of various oxide ceramics. The pores 29 of the spongy, mechanically very stable ceramic structure are filled with a material having low surface energy. The advantage of this layer construction lies in the very high mechanical stability due to the spongy ceramic structure and the possibility of setting the electrical conductivity within wide limits. The required anti-adhesive property is maintained by the regions filled with materials having low surface energy. Because the spongy, filled structure is present throughout the entire layer volume, the anti-adhesive and electrically conductive requirements on the surface of cylinder sheath 22 are maintained even when there is wear.

The coating of cylinder sheath 22 with a porous ceramic sprayed layer takes place for example with a mixture of aluminum oxide and titanium oxide, but can also take place with other ceramic materials having similar physical properties, such as for example chromium oxide. The specific volume resistance of the layer material can hereby be set via the mixing ratio of the initial materials. The porosity that can be achieved in the manufacturing process is in the range of approximately 20%, whereby the average pore diameter is from 20 to 100 μm. After the thermal spraying, the pores are infiltrated with a thin flowing polymer lacquer, for example PFA, or other polymers having anti-adhesive properties (PTFE), under normal air pressure conditions or in a vacuum chamber. The polymer material thereby penetrates into the porous thermally sprayed spongy carrier material, down to the base of the coating. The anti-adhesive material can hereby be realized so as to be insulating or electrically conductive, because the electrical charge transport takes place via the ceramic framework, which is porous and can be electrically adjusted.

In the exemplary embodiments, the cylinder sheath can also comprise a first layer made of an electrically non-conductive material, for example a plastic, onto which the electrically conductive anti-adhesive layer is then applied.

Figure 6:
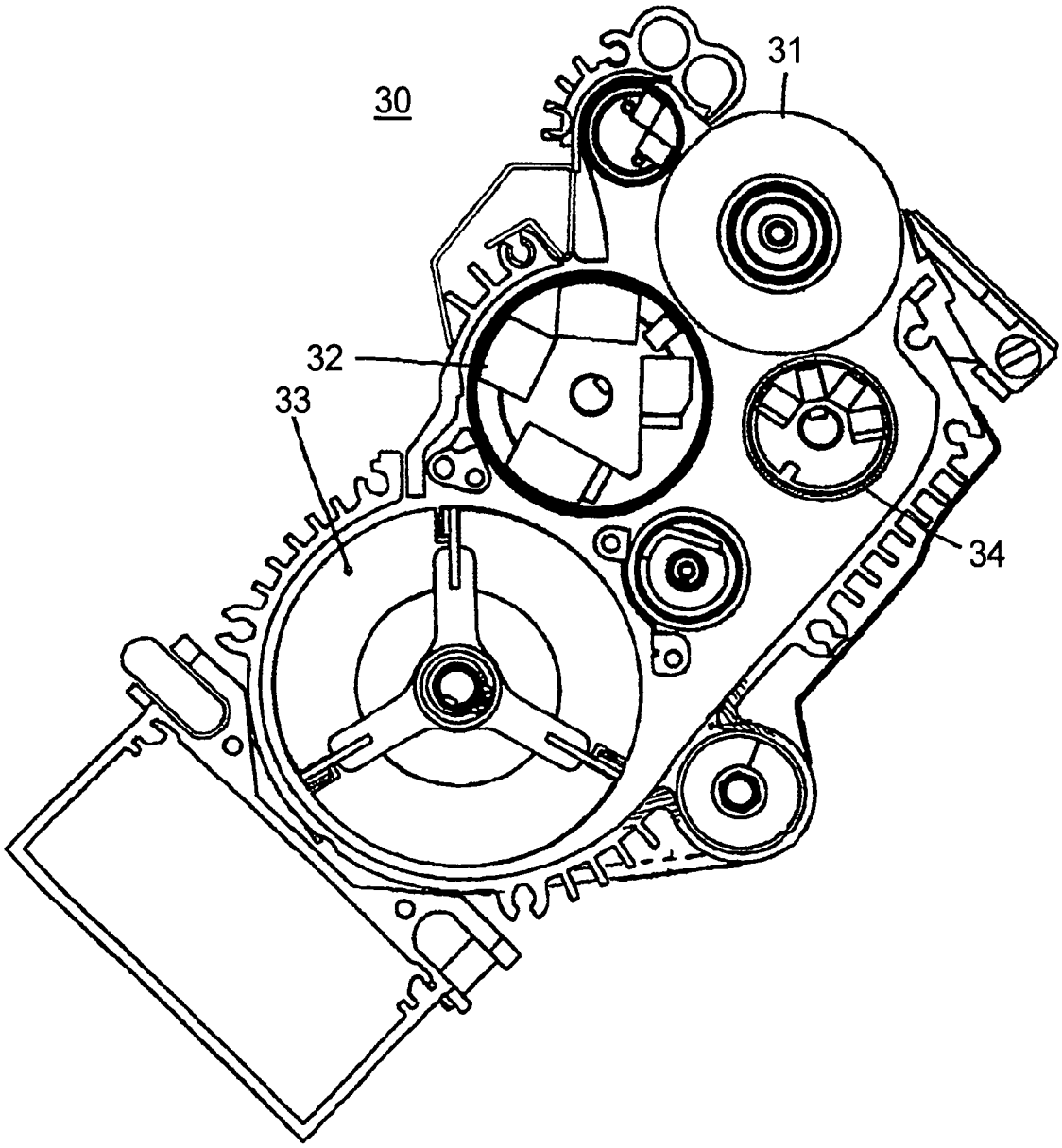
FIG. 6 shows a developer station in which the device is used.

From FIG. 6, there results a developer station corresponding to U.S. Pat. No. 6, 181,902 B1, and DE 101 52 892.2. Depicted is an example of a developer station 30 that is used for a strip-shaped intermediate carrier (not shown). In the following, only those components of developer station 30 are explained that are required for the specification.

Developer station 30 comprises a developer chamber in which the developer, made up for example of toner and carrier, is contained, and in which the components used for the developing are situated. In the example of FIG. 6, these components are:

- an applicator cylinder 31 that is situated adjacent to the intermediate carrier and that transports toner for developing the charge images through the tinting gap formed between applicator cylinder 31 and the intermediate carrier;
- a transfer cylinder 32 that is made up of a movable sheath and a magnet situated in the interior and that transports developer from the developer reservoir into the vicinity of applicator cylinder 31 and that is adjacent to a voltage that differs from that of the applicator cylinder, in such a way that the toner moves from the transfer cylinder to the applicator cylinder;
- a cleaning cylinder 34 that cleans off the toner remaining on applicator cylinder 31 after the developing.
- a blade cylinder 33 is also provided.

The developer, made up of carrier and toner, is transported by transfer cylinder 32 from the developer reservoir into the vicinity of application cylinder 31. Due to the voltage present between applicator cylinder 31 and transfer cylinder 32, the toner is taken over from applicator cylinder 31 and is moved past the intermediate carrier, so that toner moves onto the intermediate carrier in a manner corresponding to the charge images thereon. After the tinting of the charge images, toner that still adheres to applicator cylinder 31 is cleaned by cleaning cylinder 34.

Cleaning cylinder 34 is in particular realized corresponding to FIGS. 3–5. It is particularly advantageous if the cylinder sheath of the cleaning cylinder is realized in a manner corresponding to FIG. 4, whereby it is especially economical if the rough surface of the cylinder sheath is not filled with an anti- adhesive plastic. The precise function of such a cleaning cylinder can be learned from DE 101 52 892.2.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

We claim as our invention:

1. A device for transporting toner in an electrophotographic printing or copying device, comprising:

a rotatable cylinder having a cylinder sheath for the transport of the toner;

the cylinder sheath comprising a metallic layer having a surface with a roughness such that at least one of peaks and columns are provided along with recesses;

the recesses of the surface are filled with a plastic; and the cylinder comprising a cleaning cylinder for a toner deposition unit.

2. A developer station in an electrophotographic printing or copying device, comprising:

a transfer cylinder that transports a developer comprising toner and carrier to an applicator cylinder;

the applicator cylinder takes over the toner from the developer and transports it past an intermediate carrier;

adjacent to the applicator cylinder a cleaning cylinder device that cleans residual toner and developer from the applicator cylinder; and the cleaning cylinder device comprising a rotatable cylinder having a cylinder sheath, the cylinder sheath comprising a metallic layer with a surface having a roughness such that at least one of peaks and columns are provided along with recesses; and the recesses of the surface are filled with a plastic.

3. A device for transporting toner in an electrophotographic printing or copying device, comprising:

a rotatable cylinder having a cylinder sheath for the transport of the toner; and the cylinder sheath comprising a layer of a porous ceramic material having a roughness of approximately 20–80 μm.

4. A device of claim 3 in which the pores are filled at least partly with plastic.

5. A device of claim 3 in which the pores have a diameter of approximately 20–100 μm.

6. A device of claim 3 in which the plastic comprises PFA.

7. A device of claim 3 in which the plastic comprises at least one of PTFE and a PTFE derivate.

8. A device of claim 3 in which the layer comprises a volume resistance in the range up to $10^9$ Ωcm.

9. A device of claim 3 wherein the cylinder comprises a magnetic cylinder for transporting developer to a toner deposition unit in a developer station of the electrophotographic printing or copying device.

10. A device of claim 3 wherein the cylinder comprises a cleaning cylinder for a toner deposition unit.

11. A developer station in an electrophotographic printing or copying device, comprising:

a transfer cylinder that transports a developer comprising toner and carrier to an applicator cylinder;

the applicator cylinder takes over the toner from the developer and transports it past an intermediate carrier;

adjacent to the applicator cylinder a cleaning cylinder device that cleans residual toner and developer from the applicator cylinder; and the cleaning cylinder device comprising a rotatable cylinder having a cylinder sheath, the cylinder sheath comprising a layer made of a porous ceramic material having a roughness of approximately 20–80 μm.

12. A device for transporting toner in an electrophotographic printing or copying device, comprising:

a rotatable cylinder having a cylinder sheath for the transport of the toner; and the cylinder sheath comprising a layer made of a porous, thermal, electrically conductive ceramic sprayed layer.

13. A device of claim 12 in which the pores are filled at least partly with plastic.

14. A device of claim 12 in which the pores have a diameter of approximately 20–100 $\mu$m.

15. A device of claim 12 in which the plastic comprises PFA.

16. A device of claim 12 in which the plastic comprises at least one of PTFE and a PTFE derivate.

17. A device of claim 12 in which the layer comprises a volume resistance in a range up to $10^9$ Ωcm.

18. A device of claim 12 wherein the cylinder comprises for transporting developer to a toner deposition unit a developer station of the electrophotographic printing or copying device.

19. A device of claim 12 wherein the cylinder comprises a toner deposition unit.

20. A developer station in an electrophotographic printing or copying device, comprising:

a transfer cylinder that transports a developer comprising toner and carrier to an applicator cylinder;

the applicator cylinder takes over the toner from the developer and transports it past an intermediate carrier;

adjacent to the applicator cylinder a cleaning cylinder device that cleans residual toner and developer from the applicator cylinder; and the cleaning cylinder device comprising a rotatable cylinder having a cylinder sheath, and the cylinder sheath comprising a layer made of a porous, thermal, electrically conductive ceramic sprayed layer.

* * * * *